US005340217A

United States Patent [19]

Rothman

[11] Patent Number: 5,340,217

[45] Date of Patent: Aug. 23, 1994

[54] FLEXIBLE BULK CONTAINER LIFTING MEANS CONSTRUCTION

[76] Inventor: Herbert B. Rothman, 5965 Hickory Hill Square, Memphis, Tenn. 38115

[21] Appl. No.: 999,714

[22] Filed: Dec. 31, 1992

Related U.S. Application Data

[63] Continuation-in-part of Ser. No. 693,588, Apr. 30, 1991, abandoned.

[51] Int. Cl.[5] ..... B65D 33/10

[52] U.S. Cl. ..... 383/17; 383/20; 383/24

[58] Field of Search ..... 383/17, 20, 24, 107, 383/108

[56] References Cited

U.S. PATENT DOCUMENTS

| | | | |
|---|---|---|---|
| 3,961,655 | 6/1976 | Nattrass et al. . | |
| 4,010,784 | 3/1977 | Nattrass et al. . | |
| 4,081,011 | 3/1978 | Krause . | |
| 4,207,937 | 6/1980 | Sandeman et al. . | |
| 4,224,970 | 9/1980 | Williamson et al. . | |
| 4,301,848 | 11/1981 | Beaven et al. . | |
| 4,307,764 | 12/1981 | Nattrass . | |
| 4,356,853 | 11/1982 | Sekiguchi . | |
| 4,362,199 | 12/1982 | Futerman | 383/20 X |
| 4,364,424 | 12/1982 | Nattrass . | |
| 4,457,456 | 7/1984 | Derby et al. . | |
| 4,479,243 | 10/1984 | Derby et al. . | |
| 4,480,766 | 11/1984 | Platt . | |
| 4,493,109 | 1/1985 | Nattrass . | |
| 4,499,599 | 2/1985 | Polett et al. . | |
| 4,521,911 | 6/1985 | Vance . | |
| 4,524,457 | 6/1985 | Marino . | |
| 4,597,102 | 6/1986 | Nattrass . | |
| 4,610,028 | 9/1986 | Nattrass . | |
| 4,646,357 | 2/1987 | Nattrass . | |
| 4,658,432 | 4/1987 | Lehmann et al. . | |
| 4,664,957 | 5/1987 | van de Pol . | |
| 4,703,517 | 10/1987 | Marino . | |
| 5,108,196 | 4/1992 | Hughes | 383/17 |
| 5,244,280 | 9/1993 | Porter et al. | 383/17 |

FOREIGN PATENT DOCUMENTS

| | | | |
|---|---|---|---|
| 1602726 | 11/1981 | United Kingdom | 383/17 |

*Primary Examiner*—Allan N. Shoap
*Assistant Examiner*—Jes F. Pascua
*Attorney, Agent, or Firm*—Richard C. Litman

[57] ABSTRACT

The present invention discloses a construction for flexible intermediate bulk containers which provides additional strength along the upper periphery, to preclude the tearing out of the material when a loaded container is lifted by a single lifting loop. By folding the upper portion of the container over upon itself, two layers of material are provided along the upper periphery, effectively doubling the strength of that portion of the container to which the lifting loops are attached. The second layer of material is extended downwardly along the side of the container at least a distance equal to the length of the lifting loop legs to be attached thereto. The lifting loop web straps are then sewn through the two layers of material, preferably with a series of box stitches. Additional resistance to cutting due to the lifting loop web material may be provided by a redoubling of the upper periphery of the container to provide four layers of material at the upper rim, or alternatively by including a peripheral web strap along the upper periphery of the container. The construction of the present invention is applicable to bulk containers formed of either plural sheets of planar material, or to seamless tubular material of virtually any type. The folds and/or the peripheral web attachment may be formed and/or attached either inwardly or outwardly with equal facility.

17 Claims, 3 Drawing Sheets

FLEXIBLE BULK CONTAINER LIFTING MEANS CONSTRUCTION

REFERENCE TO RELATED APPLICATION

This application is a continuation in part of U.S. utility patent application Ser. No. 07/693,588 filed on Apr. 30, 1991, now abandoned.

FIELD OF THE INVENTION

The present invention relates generally to flexible containers used in the transport and/or temporary storage of various dry, pourable bulk materials, and more specifically to improvements in the construction of the upper periphery and lift loop attachment for such containers.

BACKGROUND OF THE INVENTION

Flexible intermediate bulk containers are used for the transport and/or temporary storage of various types of dry, pourable materials, such as cereal grains, chemical compounds, etc. Virtually any dry material in flake, granule, powder, or other similar form may be held by such bulk containers. These containers, also known as bulk bags or by other similar names, are capable of holding quantities of materials weighing from less than a thousand pounds to well over four thousand pounds, depending upon the density of the material, container size, and other factors.

Such containers are generally formed from sheets of synthetic fabric material, such as polypropylene, polyester or other synthetic fabric materials of the chemical family of Nylon (TM) or the like. Any of these materials may be coated in order to reduce porosity. Typically, such bulk bags measure some 35 inches on a side when empty; the depths of the containers are variable according to the amount of material to be carried in any given container, but generally range from three to seven feet in height.

Bulk containers are presently generally constructed of several sheets of material, which construction therefore requires a seam at each edge. Lifting loops of fabric web material are sewn into the four edge seams at or near the top of the bag. As this web material is some two inches in width, the hem into which the web material is sewn must be some two and a half inches wide in order for the web material to fit into the interior of the hem and stitched in place. When this construction technique is used, a great deal of extra material must be used in order to provide for the required wide hems; typically, 42 inch wide material must be used for the fabrication of a bulk bag measuring 35 inches on a side. In addition, the standard four vertical seams allow for the passage of dust or other fine residue for the bulk commodities carried within the bag, resulting in the need for additional cleanup and, with some materials, the release of potentially hazardous substances.

In order to obviate some of the above problems, bulk containers have been constructed from seamless, tubular fabric material. Such material has many advantages over the use of a plurality of flat sheets sewn together, including lower labor costs for assembly and greater strength as well as the obviation of some of the disadvantages noted above. However, it has proven difficult in some cases to attach securely the lifting loop material to bulk bags of tubular construction, due to the lack of multiple thicknesses of fabric material along seams.

Additionally, in order to comply with both domestic and international shipping regulations, such bags must meet certain standards and pass certain tests. One of the tests requires that a fully loaded bag lying on its side, be capable of being lifted to an upright position and clear of the floor by means of only a single lift strap or loop. The synthetic material of which most bulk bags are made is incapable of withstanding such a test without the addition of reinforcement around the upper perimeter. Such reinforcement is normally accomplished by the addition of web material around the upper perimeter, over the outside of the lifting straps or loops. The additional web material obviously increases the cost involved in the production of such bags.

The need arises for an improved construction of such flexible intermediate bulk containers, which construction provides the required upper peripheral reinforcement and, in at least one embodiment, obviates the need for additional web material for perimeter reinforcement. The construction must also allow for the addition of such web reinforcement of the upper perimeter if desired. In the construction of such containers from planar sheets of material, the construction must be compatible with the seam construction, and in the case of seamless tubular material, the construction must provide the required strength without the need for vertical side seams.

DESCRIPTION OF THE PRIOR ART

F. Nattrass et al. U.S. Pat. No. 3,961,655 issued Jun. 8, 1976 discloses Bulk Material Containers formed of a double bag comprising an inner liner and outer bag arrangement.

F. Nattrass et al. U.S. Pat. No. 4,010,784 issued Mar. 8, 1977 discloses Bulk Containers sewn to form a narrowed upper perimeter.

W. Krause U.S. Pat. No. 4,081,011 issued Mar. 28, 1978 discloses a Tubular Container With Suspension Elements, which construction is generally related to the field of the present invention.

A. M. Sandeman et al. U.S. Pat. No. 4,207,937 issued Jun. 17, 1980 discloses a Flexible Bulk Container formed of a fabric having a greater density of warp threads in the fabric for greater strength.

R. R. Williamson et al. U.S. Pat. No. 4,224,970 issued Sep. 30, 1980 discloses a Collapsible Receptacle For Flowable Materials including an inner liner and web slings sewn to the container.

J. P. Beaven et al. U.S. Pat. No. 4,301,848 issued Nov. 24, 1981 discloses Bags For Containing Bulk Material including an arrangement for the lifting web or strap attachment.

P. J. Nattrass U.S. Pat. No. 4,307,764 issued Dec. 29, 1981 discloses a Bulk Material Transport Bag having a specific arrangement for the attachment of the lifting loops and webs.

P. J. Nattrass U.S. Pat. No. 4,364,424 issued Dec. 21, 1982 discloses an End Wall Closure For Bulk Material Transport Bags.

F. Nattrass U.S. Pat. No. 4,493,109 issued Jan. 8, 1985 discloses a Flexible bulk Container With Integral Lifting Loops.

K. Sekiguchi U.S. Pat. No. 4,356,853 issued Nov. 2, 1982 discloses a Bag having a specific upper closure arrangement.

N. C. Derby et al. U.S. Pat. No. 4,457,456 issued Jul. 3, 1984 discloses a Collapsible Receptacle With Static Electric Charge Elimination.

N. C. Derby et al. U.S. Pat. No. 4,479,243 issued Oct. 23, 1984 discloses a Collapsible Receptacle with Prefabricated Lift Loops And Method Of Making.

N. D. Platt U.S. Pat. No. 4,480,766 issued Nov. 6, 1984 discloses a Bulk Transport Bag of non-standard construction.

W. J. Polett et al. U.S. Pat. No. 4,499,599 issued Feb. 12, 1985 discloses a Stackable Flexible Bulk Container.

R. L. Vance U.S. Pat. No. 4,521,911 issued Jun. 4, 1985 discloses a Bulk Container formed by folding the corners of a single planar sheet of material.

F. J. Marino U.S. Pat. No. 4,524,457 issued Jun. 18, 1985 discloses a Cargo Bag With Reinforced Triangular Lifting Panels.

F. J. Marino U.S. Pat. No. 4,703,517 issued Jun. 24, 1986 discloses an Intermediate Bulk Container including means for properly positioning an inner liner.

F. Nattrass U.S. Pat. No. 4,610,028 issued Sep. 2, 1986 discloses Bulk Containers having lifting loops formed from the base fabric material.

P. J. Nattrass U.S. Pat. No. 4,646,357 issued Feb. 24, 1987 discloses a Transport Bag For Particulate Material having specific lift loop attachment means.

R. Lehmann et al. U.S. Pat. No. 4,658,432 issued Apr. 14, 1987 discloses a Container For Bulk Material with overlapping edge seams.

Finally, G. M. W. van de Pol U.S. Pat. No. 4,664,957 issued May 12, 1987 discloses a Flexible Sack For Carrying Bulk Materials utilizing a specific fabric and lift loop structure.

None of the above noted patents, taken either singly or in combination, are sen to disclose the specific arrangement of concepts disclosed by the present invention.

SUMMARY OF THE INVENTION

By the present invention, an improved construction for flexible intermediate bulk containers and the like is disclosed.

Accordingly, one of the objects of the present invention is to provide an improved construction for such bulk containers which provides sufficient strength for support by a single lifting loop or web strap, by means of a novel upper perimeter cuff construction.

Another of the objects of the present invention is to provide an improved construction for bulk containers which may make use of either planar sheets of material sewn to form the sides of the container, or seamless tubular material.

Yet another of the objects of the present invention is to provide an improved construction for bulk containers which may include additional upper perimeter peripheral web material to provide greater cut or tear resistance.

Still another of the objects of the present invention is to provide an improved construction for bulk containers which ensures that the entire portion of each lift loop which is attached to the bag, is secured through at least two plies of bag material.

An additional object of the present invention is to provide an improved construction for bulk containers which precludes the cutting of the upper periphery of the bag by one or more of the lifting loop webs when the bag is lifted thereby.

A further object of the present invention is to provide an improved construction for bulk containers which may make use of any one or more of the various specific improvements detailed in the disclosure of the present invention, either singly or in combination.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Figure 1:
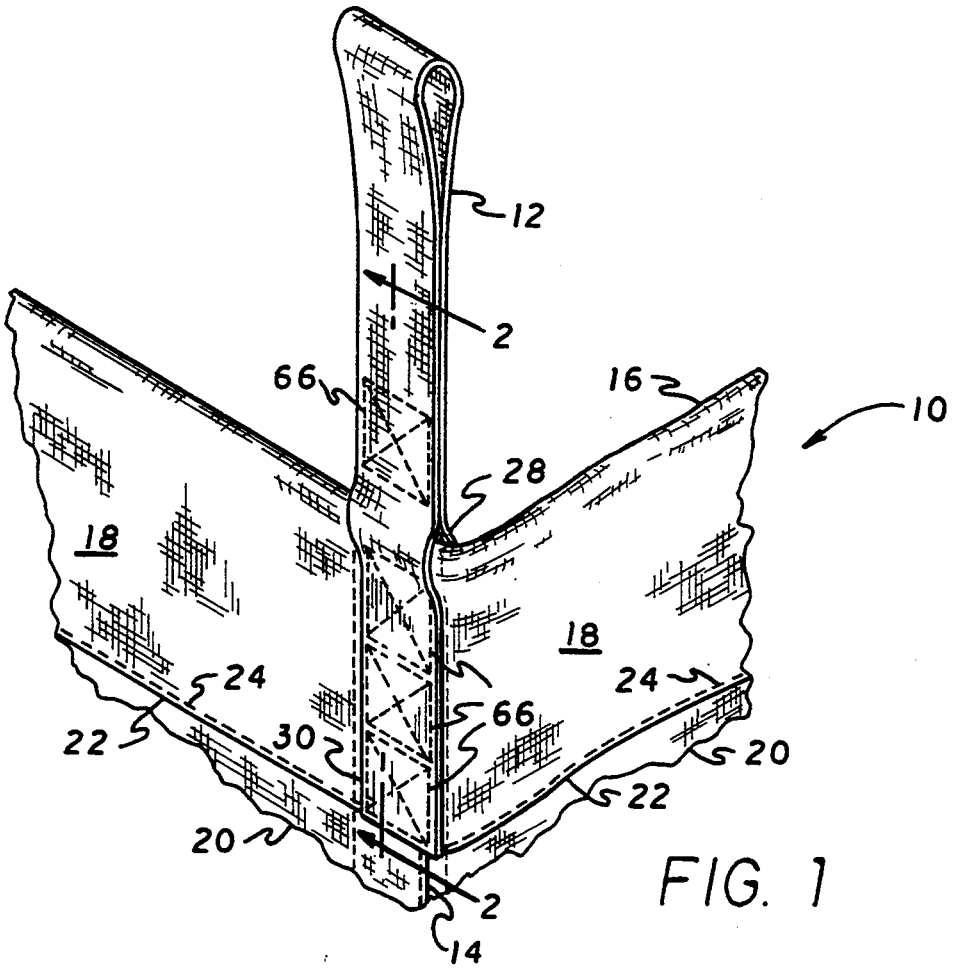
FIG. 1 is a partial perspective view of an upper corner of a flexible intermediate bulk container formed of planar sheet material and including corner seams, showing details of the attachment of the lifting loop web material to the bag material and the construction of the upper periphery of the bag.
Figure 2:
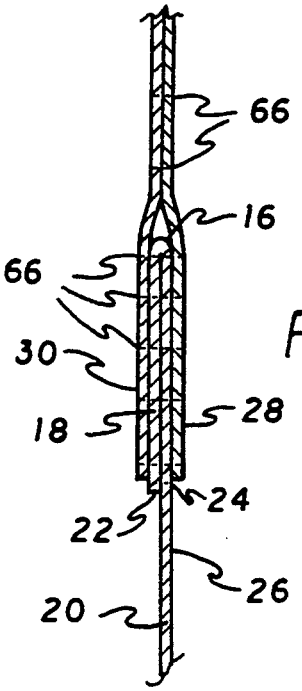
FIG. 2 is a partial cross sectional view through line 2—2 of FIG. 1, showing the sandwiching and stitching of the lifting loop web material around and through two plies of bag material.

Referring now particularly to FIGS. 1 and 2 of the drawings, the present invention will be seen to relate to a means of strengthening the upper periphery of a flexible intermediate bulk container 10 by providing multiple plies of fabric material, to which the material of a lifting loop web 12 is secured. The bulk container 10 of FIGS. 1 and 2 is formed of a plurality of individual sheets of planar fabric material, with the sheets joined along their vertical edges as at seam 14 lying under and extending downward from the attachment of lifting loop 12 to container 10. It will be understood that normally the attachment of lifting loops to such containers of sewn together construction, is along such vertical seams. It is further readily apparent that the number of plies along such a seam will at least be doubled in comparison to the number of plies forming an analogous area of the container somewhat removed from the seam. However, the additional plies of material which would ordinarily form such a seam have not been included in the partial cross section of FIG. 2 in the interest of clarity in the drawings.

While the lifting loops 12 of such bulk containers 10 are normally provided with sufficient strength to lift a loaded bulk container easily, the strength of the fabric material of such a container 10 immediately adjacent to the attachment of the lifting loop is another matter. As an entire container weighing perhaps over a ton may have to be supported by a single lifting loop, the stress concentration immediately adjacent to the loop attachment is likely to result in the tearing of a single ply of container fabric in that area. The present invention provides for means to strengthen the area adjacent the upper periphery of the container and adjacent the lifting loop attachment, without requiring excessive amounts of fabric or excessive labor for assembly.

In the embodiment of FIGS. 1 and 2, a band of material adjacent the upper periphery 16 of container 10 is folded over to provide a secondary layer 18 or cuff of material overlying the primary layer of material 20 which comprises the majority of the container 10. The edge 22 of the secondary layer or ply 18 is then stitched to the primary ply 20 of container 10 as at stitching 24, to provide the two plies of fabric needed to preclude the tearing of container 10 when lifted by a single loop 12. The second ply 18 of material may be folded outwardly as shown in FIGS. 1 and 2 to provide a relatively smooth inner surface 26 for container 10, or may alternatively be folded inwardly if desired. The important point to note is that the two plies of material 18 and 20 provided by the above construction, be sufficiently deep so as to provide two plies 18 and 20 of material to be sandwiched between the entire inner leg 28 and outer leg 30 of lifting loop 12, as shown in FIGS. 1 and 2. The resulting two thicknesses 18 and 20 of material serve to double the effective strength of the upper periphery of the container 10, and further to spread the stress developed when a loaded container 10 is lifted by a lifting loop web 12.

Normally, the two legs 28 and 30 of lifting loops 12 will extend downwardly along the sides of container 10 a distance of some eight inches from the upper rim 16, and the second layer or cuff 18 of container 10 will be folded downward an equal or slightly greater distance. However, it will be understood that this distance may be varied according to the purpose of the specific container to which the present invention is applied. In the event that relatively lightweight commodities are to be carried within such a container, the two legs of the lifting loops may extend a shorter distance downward along the sides of the container. In such a case, the doubled upper band provided by the present invention may also extend downward the same distance; again, the important point to note is that the construction of the present invention provides at least two plies of material sandwiched between the two legs of the lifting loops of the container, to whatever distance the lifting loops extend downward along the sides of the container.

Figure 3:
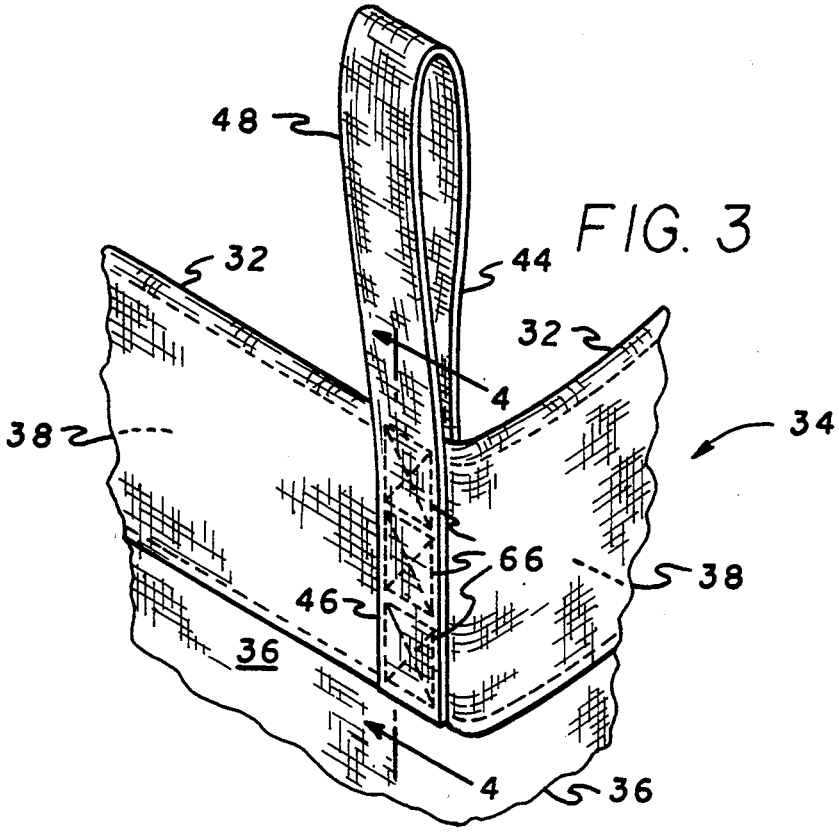
FIG. 3 is a partial perspective view of an upper corner of a flexible intermediate bulk container formed of seamless tubular material, showing the attachment of the lifting loop web material and the construction of the upper periphery of the bag.
Figure 4:
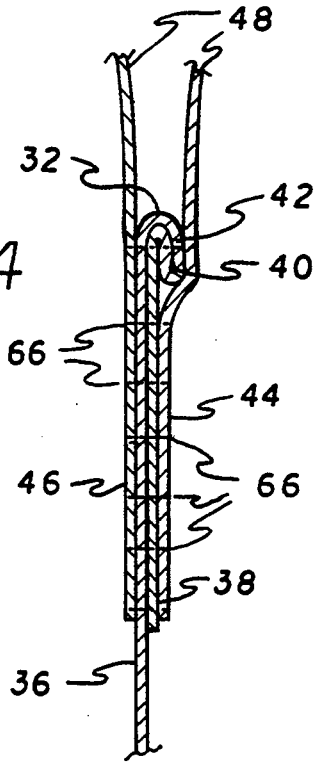
FIG. 4 is a partial cross sectional view through line 4—4 of FIG. 3, showing the sandwiching and stitching of the lifting loop web material to the bag of FIG. 3, and the construction of the upper periphery of such a seamless tubular bag.

While the two plies of fabric material provided in the embodiment of FIGS. 1 and 2 provide sufficient strength to preclude the tearing out of the fabric adjacent to a lifting loop, the relatively dense material of which such lifting loops are formed may damage or cut the upper rim of the container to which they are sewn. In order to preclude such an occurrence, additional plies of material or other thickening or strengthening of the upper rim may be necessary. The embodiment of FIGS. 3 and 4 provides such a thickened or strengthened upper rim 32 of a container 34 by redoubling the upper peripheral first and second plies 36 and 36 with a second fold, to provide additional third and fourth plies or layers 40 and 42. In most other respects, the embodiment of FIGS. 3 and 4 is essentially identical to that of FIGS. 1 and 2, in that the first and second plies 36 and 38 extend downward along the sides of the container 34 a distance at least as far as the inner and outer legs 44 and 46 of lifting loop 48. However, it will be noted that the first ply or layer 36 which forms the majority of container 34, lies to the outside of the inwardly folded second ply 38, opposite the fold of the embodiment of container 10 of FIGS. 1 and 2. It will be apparent to those skilled in the art of the present invention that the fold providing the cuff or second ply 18 of container 10 or the second ply 38 of container 34, may be made oppositely to that shown in the drawings. In other words, the cuff 18 of container 10, FIGS. 1 and 2, may be folded inwardly, and the cuff or second ply of container 34, FIGS. 3 and 4, may be folded outwardly, without departing from the spirit and scope of the present invention. Similarly, the redoubled upper rim 32 of the embodiment of FIGS. 3 and 4 may be folded outwardly if desired. The redoubled upper rim 32 need not be extended downwardly along the side of container 34 to any great depth; a fraction of an inch to an inch is sufficient to provide the additional strength along the rim 32 to preclude the cutting of the rim by the web strap material.

Another difference between the embodiment of FIGS. 1 and 2 and that of FIGS. 3 and 4, is that the container 34 of FIGS. 3 and 4 is formed of seamless tubular fabric material rather than several plies of planar material, as in the case of container 10 of FIGS. 1 and 2. It will be apparent to one skilled in the art of the present invention, that the means of strengthening the upper portion of a flexible bulk container disclosed in the embodiments discussed above may be applied equally to containers constructed of plural plies of planar material or to containers formed of seamless tubular material.

Figure 5:
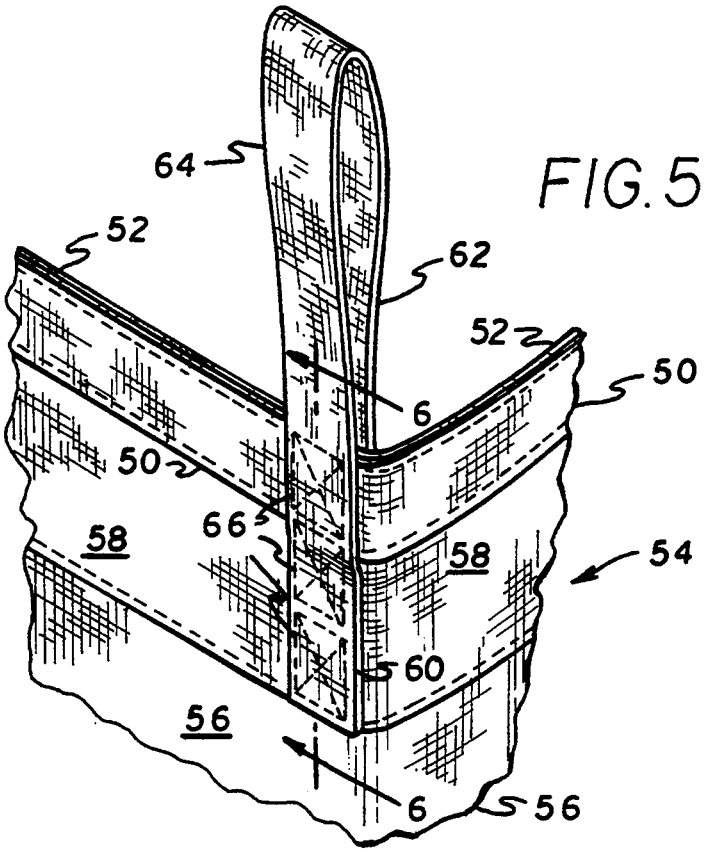
FIG. 5 is a partial perspective view of an upper corner of a flexible intermediate bulk container formed of seamless tubular material and including an additional peripheral ply of web material to strengthen the upper periphery of the bag.
Figure 6:
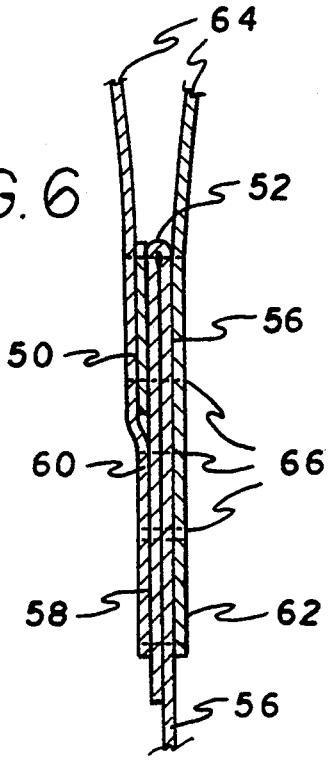
FIG. 6 is a partial cross sectional view through line 6—6 of FIG. 5, showing the construction details of the bag of FIG. 5.

As an alternative to the redoubled rim 32 of FIGS. 3 and 4, other means of providing the required durability to preclude cutting by the lifting loops may be achieved by securing additional web material 50 to the folded upper periphery 52 of the container 54 of FIGS. 5 and 6. It will be seen that this embodiment also includes a first layer or ply of material 56 forming the majority of container 54, and a second layer or ply of material 58 formed by folding an upper band of material over, in the manner of the embodiments of container 10 and 34 discussed above. The second ply 58 extends sufficiently far down the side of the container 54, to allow the entire lengths of the first and second legs 60 and 62 of the lifting loop 64 to be secured through both plies 56 and 58, in the manner of the other embodiments. As in the case of the earlier discussed embodiments of containers 10 and 34, it will be evident that the second ply of material 58 and/or the peripheral web material 50 may be secured to either the inner side of the upper periphery of the container, or to the outer side of the upper periphery as shown.

The three embodiments discussed above will be seen to provide means of strengthening the upper portions of flexible bulk contains and providing for the secure attachment of lifting loops thereto. In each of the embodiments, the two legs of each of the lifting loops extend downwardly from the upper rim of the container to sandwich or capture two plies or layers of container material therebetween. Further, the legs of the lifting loop web material are preferably secured to the containers in a similar manner in each of the three embodiments, with multiple stitching along the lengths of the legs. The "box" stitch pattern 66 shown in the embodiments of FIGS. 1, 3 and 5 and in the corresponding sectioned side views, wherein a series of rectangular and diagonal stitches are provided to secure the lifting loops to the containers, has been found to provide sufficient strength and durability to met the intended needs and requirements of such containers. Preferably, a series of at least three box stitches is provided along and through the legs of the lifting loop web material, with an optional additional box stitch through the bottom of the loop for additional strength as shown in FIG. 1. Other attachment systems or means may also be provided.

This construction, wherein the entire attachment portions or legs of the lifting loops are secured through at least two layers or plies of the container material, will be seen to provide sufficient strength to allow a loaded container to be lifted by a single lifting loop, as required to meet applicable standards. Additional modifications to the basic concept, such as the strengthening of the upper rim of the contains by means of additional plies of material provided by an additional fold, or by the addition of peripheral web material, further serve to provide increased durability for the containers of the present invention by precluding the cutting or tearing of the upper edge of the containers due to the relatively dense and hard material of the lifting loop webs. While the present invention is directed primarily to containers of standard materials, such as polyester or polypropylene fabrics, the construction system of the present invention may be extended to flexible bulk containers constructed of other materials also.

It is to be understood that the present invention is not limited to the embodiments described above, but encompasses any and all embodiments within the scope of the following claims.

I claim:

1. A construction for a flexible intermediate bulk container substantially formed of sheet material, said container having an upper peripheral edge with a plurality of lifting loops having first and second legs secured thereto, with said construction consisting essentially of:

said upper peripheral edge of said container folded over upon itself to provide a first layer and a second layer of said sheet material in said upper peripheral edge, and an upper rim defined by said fold; and said first and second legs of each said lifting loops sandwiching and capturing said first and second layers of said sheet material in said upper peripheral edge therebetween and secured therethrough; whereby said construction provides sufficient strength for said container to be fully loaded and lifted by a single one of said lifting loops without damage to said material of said container.

2. The construction of claim 1 wherein:

said container is formed of a plurality of planar sheets of material.

3. The construction of claim 1 wherein:

said container is formed of seamless tubular material.

4. The construction of claim 1 wherein:

each of said lifting loops is secured to said first and second layers of material by means of a plurality of box stitches.

5. The construction of claim 4 wherein:

said plurality of box stitches comprise three box stitches disposed along and through said first and second lifting loop legs and said first and second layers of material.

6. The construction of claim 4 wherein:

at least one additional box stitch positioned above said upper periphery and through said lifting loop.

7. The construction of claim 1 wherein:

said upper peripheral edge of said container is outwardly folded over upon itself, whereby;

said second layer of material is disposed outside of said first layer of material.

8. The construction of claim 1 wherein:

said upper peripheral edge of said container is inwardly folded over upon itself, whereby;

said second layer of material is disposed inside of said first layer of material.

9. The construction of claim 1 wherein:

said second layer of material extends downwardly eight inches over said first layer of material, and said first and second legs of each said lifting loops extend downwardly eight inches from said upper rim.

10. The construction of claim 1 wherein:

said sheet material is polyester fabric.

11. The construction of claim 1 wherein:

said sheet material is polypropylene fabric.

12. The construction of claim 1 wherein:

said upper periphery of said container is redoubled by means of a second fold, whereby;

four layers of material adjacent said upper rim are provided to preclude cutting damage to said upper rim due to said lifting loops.

13. The construction of claim 12 wherein:

said redoubled upper periphery is folded outwardly.

14. The construction of claim 12 wherein:

said redoubled upper periphery is folded inwardly.

15. The construction of claim 1 wherein:

said upper periphery of said container is provided with peripheral web material secured thereto, whereby;

said peripheral web material precludes cutting damage to said upper rim due to said lifting loops.

16. The construction of claim 15 wherein:

said peripheral web material is secured to said first layer of material.

17. The construction of claim 15 wherein:

said peripheral web material is secured to said second layer of material.

* * * * *